US005707420A

United States Patent [19]

Langner et al.

[11] Patent Number: 5,707,420

[45] Date of Patent: Jan. 13, 1998

[54] PROCESS FOR THE PRODUCTION OF A COPPER POWDER CONTAINING DISPERSOIDS

[75] Inventors: Bernd E. Langner, Winsen; Peter Stantke, Apensen; René-Holger Wilde, Badendorf, all of Germany

[73] Assignee: Norddeutsche Affinerie Aktiengesellschaft, Hamburg, Germany

[21] Appl. No.: 534,038

[22] Filed: Sep. 26, 1995

[30] Foreign Application Priority Data

Sep. 27, 1994 [DE] Germany ..... 44 34 393.0

[51] Int. Cl.[6] ..... B22F 9/26

[52] U.S. Cl. ..... 75/365; 75/368; 75/369; 75/373

[58] Field of Search ..... 75/363, 364, 365, 75/368, 369, 373

[56] References Cited

U.S. PATENT DOCUMENTS

| | | | |
|---|---|---|---|
| 3,310,400 | 3/1967 | Alexander et al. | 75/365 |
| 3,313,616 | 4/1967 | Tuvell | 75/369 |
| 3,492,115 | 1/1970 | Mahalla | 75/373 |
| 4,462,845 | 7/1984 | Klar et al. | 75/369 |
| 4,944,935 | 7/1990 | Langner et al. | 423/604 |

FOREIGN PATENT DOCUMENTS

| | | | |
|---|---|---|---|
| 3-150302 | 6/1991 | Japan | 75/365 |
| 2083500 | 3/1982 | United Kingdom . | |

*Primary Examiner*—George Wyszomierski

*Attorney, Agent, or Firm*—Harness, Dickey & Pierce, P. L. C.

[57] ABSTRACT

The copper powder contains at least one substance, which is not soluble in copper, e.g. $Al_2O_3$, $TiO_2$, $SiO_2$ or $B_2O_3$. For the production of this copper powder, a surplus of copper metal granulate is mixed with an ammonium salt and/or ammonium hydroxide, together with a saline solution in an aqueous solution, while a gas containing oxygen is added, and at a pH-value of at least 4. A copper-containing precipitate is produced, which is separated and treated at a temperature in the range from 150° to 500° C. in a reducing atmosphere. During this process, $Cu(OH)_2$ and Cu-oxide are transformed into metallic copper powder, which contains the dispersoid. The dispersoid content of the copper powder is preferably in the range from 0.1 to 5% by weight.

13 Claims, No Drawings

PROCESS FOR THE PRODUCTION OF A COPPER POWDER CONTAINING DISPERSOIDS

BACKGROUND AND SUMMARY OF THE INVENTION

The invention concerns a process for the production of a copper powder, which contains as a dispersoid at least one substance, which is not soluble in copper, as well as a copper powder of this type.

From DE-A-31 30 920 (see correspondence in GB-A-20 83 500), a process for the production of copper powder is known, in which the grains of copper have a coating of $Al_2O_3$. In carrying out this process, an effort is made to provide as homogeneous an aluminum oxide coating as possible to the copper metal particle, while the interior of the copper metal particles remains free of aluminum oxide. In order to achieve homogeneous properties for the parts and devices, which are made from the copper powder, very small particle sizes of the copper metal particles of less than 50 μm are used in the production process, and care is taken to see to it that the aluminum oxide coating on the particles is continuous.

The invention is based on the objective of producing a copper powder containing dispersoids in a simple way. At the same time, the grains of copper powder are to contain the dispersoid in the interior in as uniform a distribution as possible. This objective is achieved by the process according to the invention, in which a surplus of a copper metal granulate is mixed in a mixing zone with an ammonium salt and/or ammonium hydroxide along with a metered addition of a saline solution in an aqueous solution with the addition of a gas, which contains oxygen, with a ph-value of at least 4, and in which a copper-containing precipitate of copper metal granulate is produced, and where the precipitate of copper metal granulate is separated and treated at a temperature in the range from 150° to 500° C. in a reducing atmosphere until the $Cu(OH)_2$ and Cu-Oxide are completely changed into metallic copper powder, and which cools the copper powder containing the dispersoid. The metered addition of the saline solution is selected in such a manner, that it forms a precipitate in the mixing zone, which is deposited at the same time as the precipitate which contains copper. The precipitate generated by the saline solution is here also referred to as a dispersoid precursor compound.

DESCRIPTION OF THE PREFERRED EMBODIMENT

In the process according to the invention, the conditions for the generation of the copper-containing precipitate are chosen more or less in the manner in which it is described in the EP patent 0 235 841 and in the U.S. Pat. No. 4,944,935 corresponding to it. The temperature in the mixing zone is generally in the range from 5° to 70° C.

The copper powder, which is produced by the process according to the invention, contains the dispersoid in the interior of the grains of copper powder in a largely homogeneously distributed form, which is assured by the joint precipitation of copper compounds, e.g. copper hydroxide, with the dispersoid-precursor-compound. The compound mixture is subsequently thermally treated and reduced. Most of the time, the dispersoid content of the copper powder is about from 0.1 to 5% by weight.

Various substances are worth considering for use as dipersoids, in particular oxides; of special importance are $Al_2O_3$, $B_2O_3$, $SiO_2$ or $TIO_2$. In this case, the caustic neutralization of the copper takes place in the mixing zone during the metered addition of, e.g. a solution of a salt of the elements Al, B, Si or Ti; and, along with the copper-containing precipitate, the dispersoid precursor compound is also precipitated. In this manner, the subsequent homogeneous distribution of the dispersoid in the interior of the grains of copper powder is assured. The additional explanations of the process according to the invention are based on the fact that $Al_2O_3$ particles are to be embedded in the copper powder to serve as the dispersoid, but they are also analogously valid for the other dispersoids. Where different types of processes suggest themselves, this will be specifically explained below.

Copper metal granulate, e.g. in the form of copper chips or cable chips, is added to the mixing zone, while the mixing zone or the impeller type mixer contains an aqueous solution, e.g. of $NH_4OH$ and $NH_4Cl$ or of some other ammonium salt. One further adds an aluminum salt solution, e.g. Al-formate or $AlCl_3$, stirs vigorously and introduces additional air or technically pure oxygen into the solution. The pH-value in the mixing zone is kept largely constant at a level of at least 4 and preferably at a level of at least 9. Preferably, the pH-value, which is being constantly controlled, is kept largely constant by the metered addition of $NH_4OH$. If the pH-value changes too greatly during the reaction, then this will eventually lead to changes in the dispersoid concentration in the copper powder.

In the mixing zone, a part of the metallic powder will go into solution and will be precipitated after the solubility limit is exceeded, during which process oxi-salt, hydroxide and oxides are being formed, and $Al(OH)_3$ is precipitated at the same time. After a certain time following the start of the process, a stationary condition is reached, in which the concentration of copper and aluminum in the precipitate no longer changes. The solubility limit for the copper depends on the pH-value. It has happened that the precipitation of the aluminum hydroxide occurs preferentially at the copper oxide or copper hydroxide particles, which already constitute a surplus in the solution, so that the precipitates are intimately mixed with each other.

The aluminum salt solution (e.g. Al-formate $HCO_2Al$) is preferably continuously added to the suspension in the mixing zone, while the pH-value in the mixing zone is maintained at a constant level. The speed with which the Al-solution is added is determined as a function of the desired final concentration of the dispersoid in the copper powder. It is especially advantageous to maintain the pH-value at a constant level in the range of between 9 and 12 and preferably at a level of at least 10. Higher pH-values are possible, but less advantageous, because they require very large amounts of ammonium hydroxide.

After a reaction time of normally several hours in the mixing zone, the reaction is terminated, at which time the copper metal granulate is present in the mixing zone. With the use of a sieve, the copper metal granulate is initially separated from the suspension, which is flowing out of the mixing zone; then the remaining precipitate, which contains copper- and aluminum hydroxide is removed through a filter, washed and dried. Water is used for washing the precipitate. The drying is done gently at temperatures, which are initially between 30° and 80° C., and then at higher temperatures of up to 250° C., during which process a partial or complete transformation of the $CU(OH)_2$ to CuO already takes place. In order to generate the copper powder from the dried precipitate, the precipitate is reduced in a reduction furnace at temperatures in the range from 150° to 500° C. by means of a gas (e.g. $H_2$) which acts as a reducing agent.

The powdered product of the reduction process consists of metallic copper with embedded $Al_2O_3$ particles; it consists of fine grains and oxidizes easily upon contact with the oxygen contained in the air. Therefore, it is advisable to cool the product after the reduction process under a protective gas, which acts as a reducing agent or which is inert, e.g. nitrogen.

The powdery product of the reduction process is already a copper powder, which is ready for use, even if one cannot rule out the possibility that a certain amount of aluminum oxide may cling to the surface of the copper grains. In a further evolution of the process according to the invention, the powdery reduction product is subjected to a secondary treatment, in order to remove the clinging aluminum oxide from the surface of the copper grains. For this purpose, the reduction product is introduced into a diluted acidic or alkaline solution of water and, for example, NaOH or HCl. In doing this, it is recommended to use, for example, an acid or alkaline content of 2% by weight with respect to the weight of the powdery reduction product. A solid content of the suspension, which was formed, from 10 to 50% by weight would be appropriate; and one should keep the temperature of the suspension within the range from 40° to 80° C. while stirring it slightly. Subsequently, the product is washed with water, until the water used for washing is colorless. The copper powder should then be dried in a vacuum at about 30° to 60° C.

If it turns out that the copper powder has been oxidized as a result of the preceding treatment, then a follow-up reduction process is to be recommended. This follow-up reduction process takes place in a reducing atmosphere at temperatures in the range from 150° to 650° C., during which process the desired copper powder product is generated. Short-term heating of the copper powder to temperatures from 500° to 650° C. in an inert gas leads to agglomeration and grain enlargement of the powder. As a result of this, the powder becomes less sensitive to oxidation and becomes easier to press into a form. After sifting away the larger agglomerates from the powder, it is ready for its further use, during which it must be stored in an inert gas.

EXAMPLE 1

In a laboratory, 5.5 liter of water, 55 g of $NH_4NO_3$ and 83 ml of $NH_4OH$ (density of 0.91 g/l) and 1000 g of copper chips are filled into an impeller type mixer. While introducing oxygen at a rate of 150 l per hour, it is stirred vigorously for 5.5 hours, and during this time a metered addition of 500 ml of a solution of aluminum formate is continuously carried out, which solution contains 25 g of Al per liter. The pH-value is continuously monitored and kept at a constant value of 10.5 by the addition of $NH_4OH$.

After removing copper chips, which had not been dissolved, by means of a sieve, the precipitate, which contains hydroxide, is removed by filtration, washed with water and dried (18 hours at 50° C. and 2 hours at 220° C.). In order to generate the powdery reduction product, the precipitate is reduced during a period of 5 hours at 250° C. in a gas mixture, 40% by volume of which consists of $H_2$ and 60% by volume of $N_2$, and the reduction product generated in this manner is practically free from copper oxide.

In order to remove aluminum oxide, which clings to the surface, an after treatment of the reduction product takes place, which is mixed for 2 houre at 80° C. in 3 liters of an aqueous solution, which contains 20 g of NaOH. Subsequently, it is washed with water. The washed copper powder, which contains $Al_2O_3$ as a dispersoid, is kept for 30 minutes and at a temperature of 550° C. in a gas mixture, which consists of 40% by volume of $H_2$ and 60% by volume of $N_2$, in order to subject it to a follow-up reduction. Subsequently, it is cooled in the inert gas $N_2$. The copper powder, which is produced, contains 0.63% by weight of $Al_2O_3$. A test rod of a length of 100 mm and a diameter of 6 mm, which is molded from this powder under pressure and subsequently sintered at 1000° C. for 2 hours, has a tensile strength of 545 N/mm. A comparable rod of pure copper powder has a tensile strength of only 250 N/m.

EXAMPLE 2

50 liters of water, 150 g of $NH_4Cl$ and 750 ml of $NH_4OH$ (density of 0.91 g/l) are filled into an impeller type mixer, which contains 5 kg of copper chips. While introducing technically pure oxygen at a rate of 500 l per hour, it is mixed vigorously for 7 hours, during which time the copper chips are partially dissolved. In the meantime a metered addition of 1200 ml of a solution of aluminum formate (aluminum content 25 g/l) is continuously carried out, and the pH-value is kept at a constant value of 11 by the addition of $NH_4OH$. After removing copper chips, which had not been dissolved, by means of a sieve, the precipitate, which is enriched with hydroxide, is removed by filtration, washed with water, and kept at a temperature of 150° C. for 17 hours in order to dry it.

In order to reduce it, the precipitate is brought into a gas atmosphere for a period of 8 hours at 250° C., which gas consists of 40% by volume of $H_2$ and 60% by volume of $N_2$. A surplus of aluminum oxide is subsequently removed by mixing it for 2 hours at 80° C. in 20 liters of an aqueous solution, which contains 20 g of NaOH. Subsequently, it is once again washed in water. For the purpose of a subsequent reduction, the copper powder, which contains $Al_2O_3$, is mixed for half an hour in a gas mixture, which consists of 40% by volume of $H_2$ and 60% by volume of $N_2$. The copper powder thus produced contains 0.36% by weight of $Al_2O_3$. A test rod (diameter 6 mm, length 100 mm), which is molded from this powder under pressure and subsequently sintered (950° C., 6 hours) has a tensile strength of 503 N/mm.

We claim:

1. A process for the production of a copper powder that contains as a dispersoid at least one substance not soluble in copper, comprising the steps of:

(a) mixing an excess of a copper metal granulate in a mixing zone with an ammonium salt and/or ammonium hydroxide together with a metered addition of a salt in an aqueous solution, and adding along with said mixing a gas which contains oxygen, a pH-value of at least 4 being maintained in the mixing zone, wherein a precipitate of at least one copper-dispersoid precursor compound is produced;

(b) separating the precipitate from the copper metal granulate, and (c) treating the precipitate at a temperature in the range from 150° to 500° C. in a reducing atmosphere, to produce as a reduction product copper powder containing the dispersoid.

2. A process according to claim 1, comprising the further step of an after-treatment of suspending the reduction product in an acidic or alkaline solution, separating the reduction product from the solution, and washing and drying the separated reduction product, whereby any dispersoid substance on the surface of the copper powder is removed.

3. A process according to claim 2, wherein the copper powder from the after-treatment process is heated in a reducing atmosphere to temperatures in the range from 150° to 650° C. for a subsequent reduction.

4. A process according to claim 3, wherein a pH-value of at least 8 is provided in the mixing zone.

5. A process according to claim 4, wherein a pH-value in the area from 9 to 12 is used in the mixing zone and the dispersoid is $Al_2O_3$.

6. A process according to claim 2, wherein the salt of the metered addition is a salt of aluminum, boron, silicon, or titanium.

7. A process according to claim 2, wherein a pH-value of at least 8 is provided in the mixing zone.

8. A process according to claim 7, wherein a pH-value in the area from 9 to 12 is used in the mixing zone and the dispersoid is $Al_2O_3$.

9. A process according to claim 1, wherein the salt of the metered addition is a salt of aluminum, boron, silicon, or titanium.

10. A process according to claim 9, wherein a pH-value of at least 8 is provided in the mixing zone.

11. A process according to claim 10, wherein a pH-value in the area from 9 to 12 is used in the mixing zone and the dispersoid is $Al_2O_3$.

12. A process according to claim 1, wherein a pH-value of at least 8 is provided in the mixing zone.

13. A process according to claim 12, wherein a pH-value in the area from 9 to 12 is used in the mixing zone and the dispersoid is $Al_2O_3$.

* * * * *